US005582391A

United States Patent [19]

McNair et al.

[11] Patent Number: 5,582,391

[45] Date of Patent: Dec. 10, 1996

[54] SLIDING GATE VALVE

[75] Inventors: Ian McNair, Coal Aston; Paul L. Hill, Chesterfield, both of England

[73] Assignee: Flogates Limited, England

[21] Appl. No.: 462,521

[22] Filed: Jun. 5, 1995

[30] Foreign Application Priority Data

May 3, 1995 [GB] United Kingdom ..... 9509014

[51] Int. Cl.[6] ..... F16K 3/00

[52] U.S. Cl. ..... 251/326; 251/144

[58] Field of Search ..... 251/143, 144, 251/326

[56] References Cited

U.S. PATENT DOCUMENTS

| | | | |
|---|---|---|---|
| 3,926,406 | 12/1975 | Haid | 251/144 |
| 3,937,372 | 2/1976 | Bode, Jr. | 251/144 X |
| 4,056,217 | 11/1977 | Aliprandi et al. | 251/144 X |

FOREIGN PATENT DOCUMENTS

| | | |
|---|---|---|
| 2242636 | 8/1972 | United Kingdom . |
| 1457708 | 12/1976 | United Kingdom . |
| 1518841 | 7/1978 | United Kingdom . |
| 1602717 | 11/1981 | United Kingdom . |
| 1602716 | 11/1981 | United Kingdom . |
| 2110342 | 6/1983 | United Kingdom . |
| 1483732 | 10/1991 | United Kingdom . |

*Primary Examiner*—John C. Fox

*Attorney, Agent, or Firm*—Lahive & Cockfield; Thomas J. Engellenner

[57] ABSTRACT

The invention relates to a sliding gate valve for controlling the flow of molten metal from a vessel. The valve comprises an orificed fixed plate and an orificed sliding plate slidingly mounted on a hinged support sub-assembly. The sliding plate is biased into face to face contact with the fixed plate. The biasing means applies the biasing force directly on to the contact plane defined by the meeting faces of the two plates.

12 Claims, 4 Drawing Sheets

SLIDING GATE VALVE

The present invention relates to sliding gate valves for controlling the flow of molten metal through the tap hole of a vessel, and in particular to sliding gate valves having two refractory plates.

Sliding gate valves are well known and widely used in the steel industry. They typically include a refractory sliding gate plate having at least one teeming orifice biased upwardly against a refractory top plate containing an orifice which communicates via a taphole with the interior of a vessel to which it is fixed. For example see British Patents Nos. 1602716, 1602717 and 2110342.

Molten metal flow from the vessel is controlled by sliding the sliding gate plate against the top plate, usually by means of a reciprocating ram. The orifice in the fixed top plate which communicates with the interior of the vessel cooperates with the teeming orifice of the sliding gate plate when the two orifices are slid into alignment. In this configuration (the aligned position) fluid communication between the interior of the vessel and the teeming orifice in the sliding gate plate is established allowing molten metal to flow out of the vessel. The sliding gate plate usually bears a collector nozzle (or bushings for the attachment of a collector nozzle) to permit controlled pouring of molten metal in a compact stream.

When the sliding gate plate is slid out of alignment with the fixed top plate, the interface between the plates is such that molten metal should not flow between them, and in this configuration (the non-aligned position) fluid communication between the taphole and the teeming orifice is broken by the seal produced at the interface.

Metal flow can therefore be turned on or off by sliding the sliding gate plate in or out of alignment with the top plate, respectively. During teeming, the molten metal flow can be throttled by bringing the sliding plate orifice more or less into registry with the stationary plate orifice.

In order to maintain the seal between the plate, the sliding plate is biased towards the fixed top plate by appropriate spring means. The magnitude of the biasing force is determined to be a balance between being low enough so that the sliding plate can slide over the fixed plate without excessive wear, whilst being high enough to prevent molten metal ingress between the plates. Spring weakening, plate wear and other operational factors can cause some plate separation to occur thereby allowing molten metal ingress between the plates.

In steel manufacture, a significant proportion of the cost arises from time spent in maintaining and replacing sliding gate valve components, plus the production down-time this involves. Accordingly, the rate of replacement of sliding gate refractory parts must be kept to a minimum. An important problem faced by workers in this field is to accommodate or limit abrasion and wear at the interface between the sliding refractory plates.

The present invention seeks to provide a sliding gate valve with a relatively long working life which is suitable for applications where down-time must be minimized. The invention also seeks to provide a valve of a design whereby metal ingress between the plates is minimised.

According to the present invention there is provided a sliding gate valve for controlling the flow of molten metal from a vessel, the valve comprising an orificed fixed plate and an orificed sliding plate slidingly mounted on a support frame, the support frame being hingedly movable between an operating position where the sliding plate is in face to face contact with the fixed plate along a contact plane and another position moved therefrom, the sliding plate being biased into said face to face contact by biasing means which exert biasing force directly onto the contact plane.

Generally, biasing spring means of sliding gate valves are applied directly or indirectly to the underside of the sliding plates. In such an arrangement, turning forces can be established which tend to tip the sliding plates out of the contact plane. The turning forces thus encourage separation of the plates and ingress of metal therebetween. This situation will be exacerbated if the spring loading becomes uneven, e.g. due to spring relaxation. We have found that such undesirable turning forces are significantly reduced or eliminated by the biasing force being applied onto the contact plane.

Advantageously, the frame includes a support portion abutting the non-contact face of the sliding plate and a rim portion extending from the support portion past the contact side of the sliding plate and the biasing means acts against a back face of the rim portion which back face is co-planar with the contact plane. This cradle-like arrangement of the frame provides a particularly compact arrangement of the sliding gate valve.

Advantageously, the sliding gate plate is slidable by means of a reciprocating ram acting on the frame. The reciprocating ram is mounted and arranged to provide a plate-actuating force which is in the contact plane. This further reduces or eliminates the development of turning forces.

In a preferred embodiment the springs means are removable from the valve whilst the sliding plate is in contact with the fixed plate. This allows maintenance and checking operations to be undertaken without dismantling the valve.

The springs of the spring means can be coil springs of conventional kinds used in the art, or thermodynamic elements—e.g. gas springs—as disclosed in our GB-A-1,457,708 and GB-A-1,518,841 the contents of which are incorporated herein by this reference. "Springs" and "spring means" mentioned hereafter are meant to embrace any such mechanical or gas spring devices.

A preferred embodiment of the invention will now be described with reference to the accompanying drawings, in which:

FIG. 3(*b*) shows the view of FIG. 3(*a*) with the valve in a 3rd position;

FIG. 3(*c*) shows the view of FIG. 1;

FIG. 3(*d*) shows the view of FIG. 1 in a dismantled position.

Figure 1:
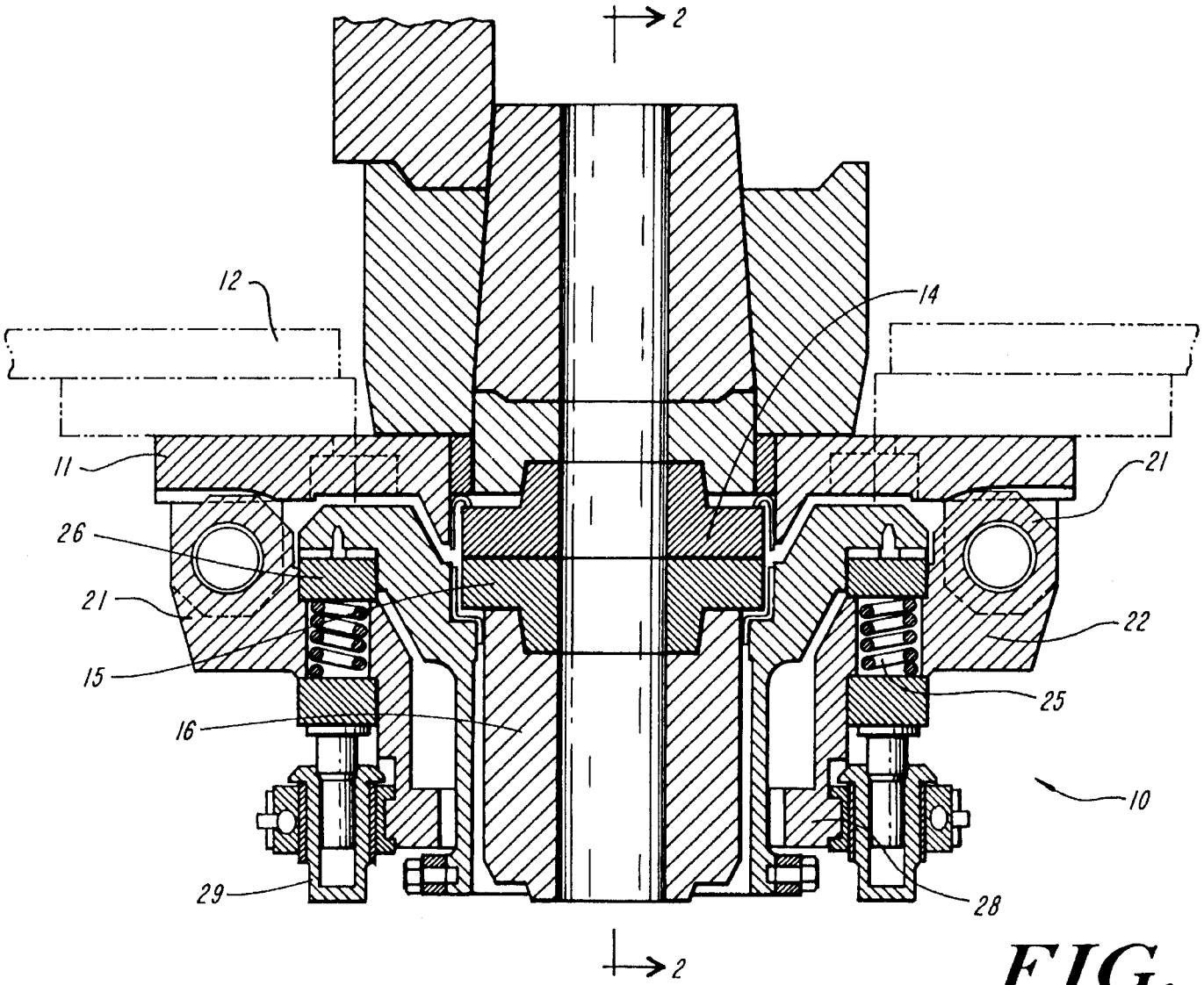
FIG. 1 shows a cross-sectional view through a sliding gate valve according to the present invention.

Referring now to the drawings, the sliding gate valve 10 is shown fitted on to the bottom of a vessel 12 e.g. a ladle or a tundish, over an opening therein.

The sliding gate valve 10 comprises a top fixed plate 14 and a bottom sliding plate 15 in face to face contact with the former.

The fixed plate 14 has an orifice aligned with the opening in the vessel 12. The sliding plate 15 has a similar orifice to the fixed plate 14. The sliding plate 15 is slidable between opened, closed and throttling positions respectively aligned, non-aligned and partially aligned with the orifice in the fixed plate 14. The sliding plate 15 has a nozzle 16, attached immediately below its orifice for directing fluid flow therethrough.

Figure 2:
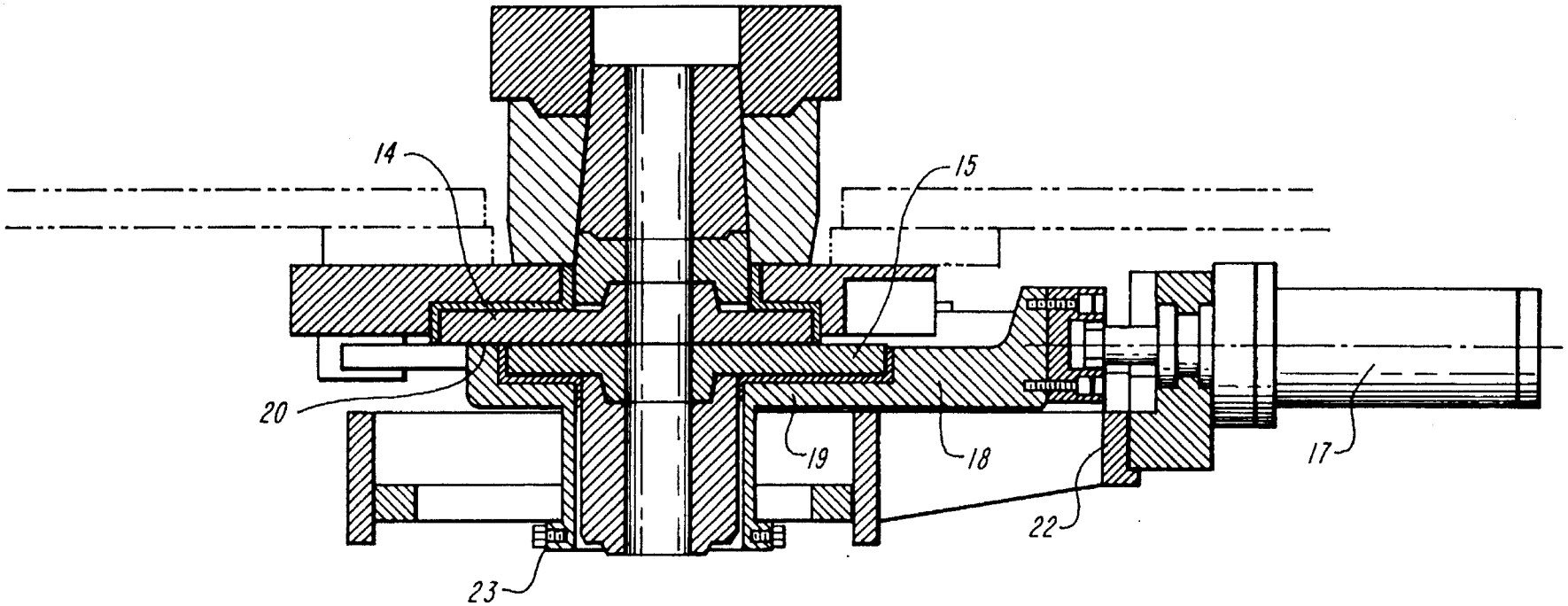
FIG. 2 shows a cross-sectional view along the line A—A of FIG. 1.
Figure 3A:
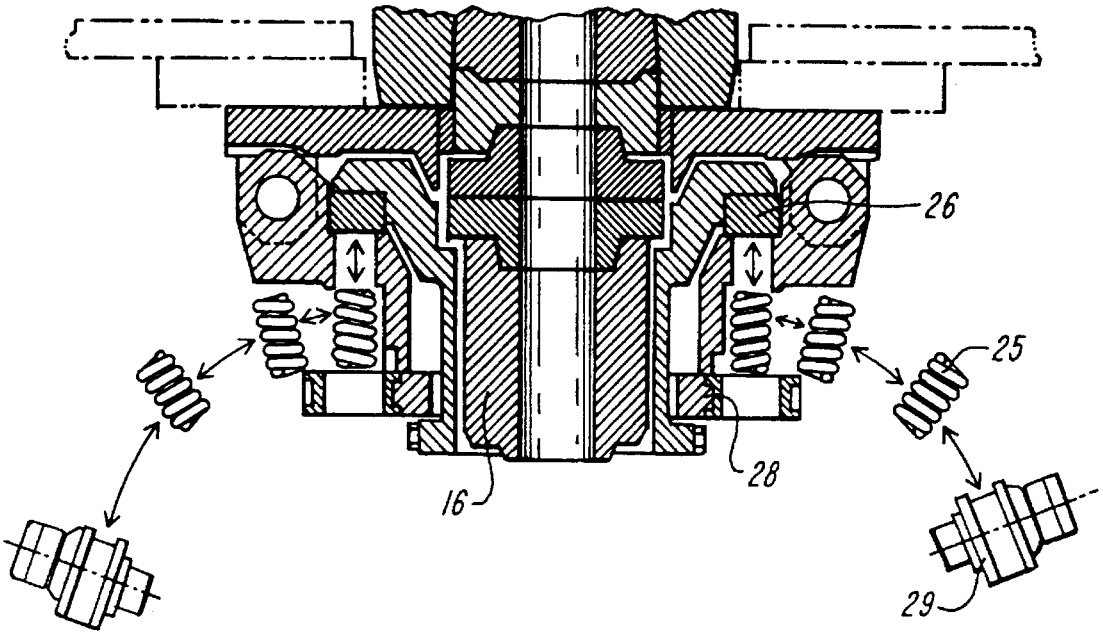
FIG. 3(*a*) shows the view of FIG. 1 with the valve in a 2nd position.
Figure 3B:
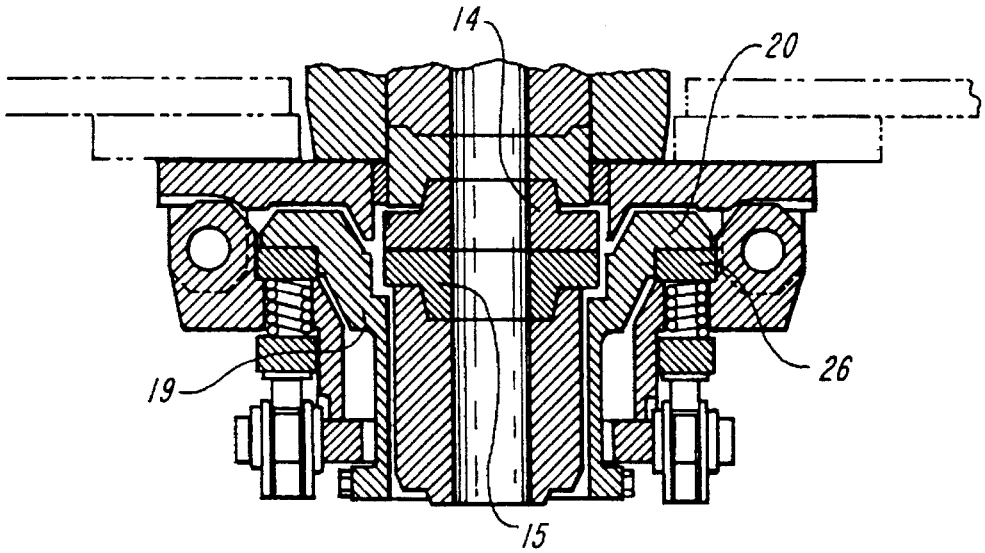
Figure 3C:
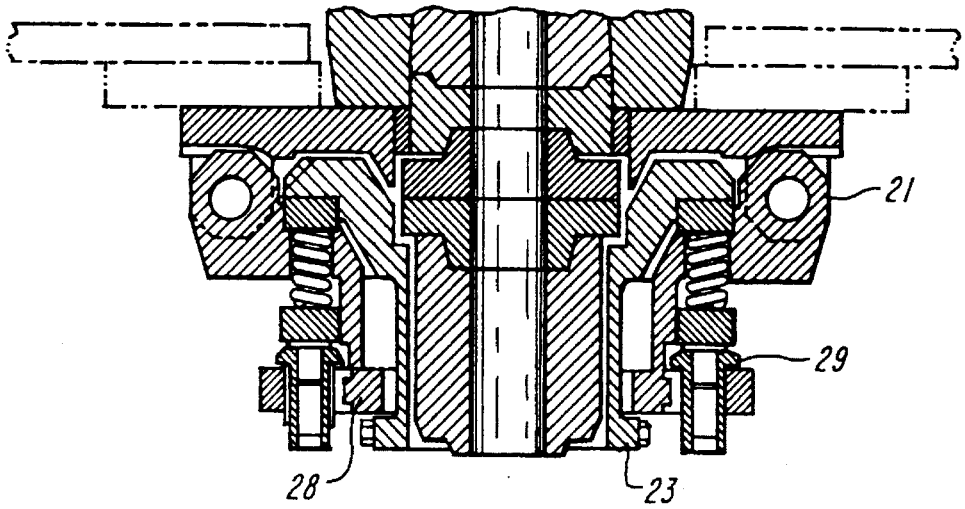
Figure 3D:
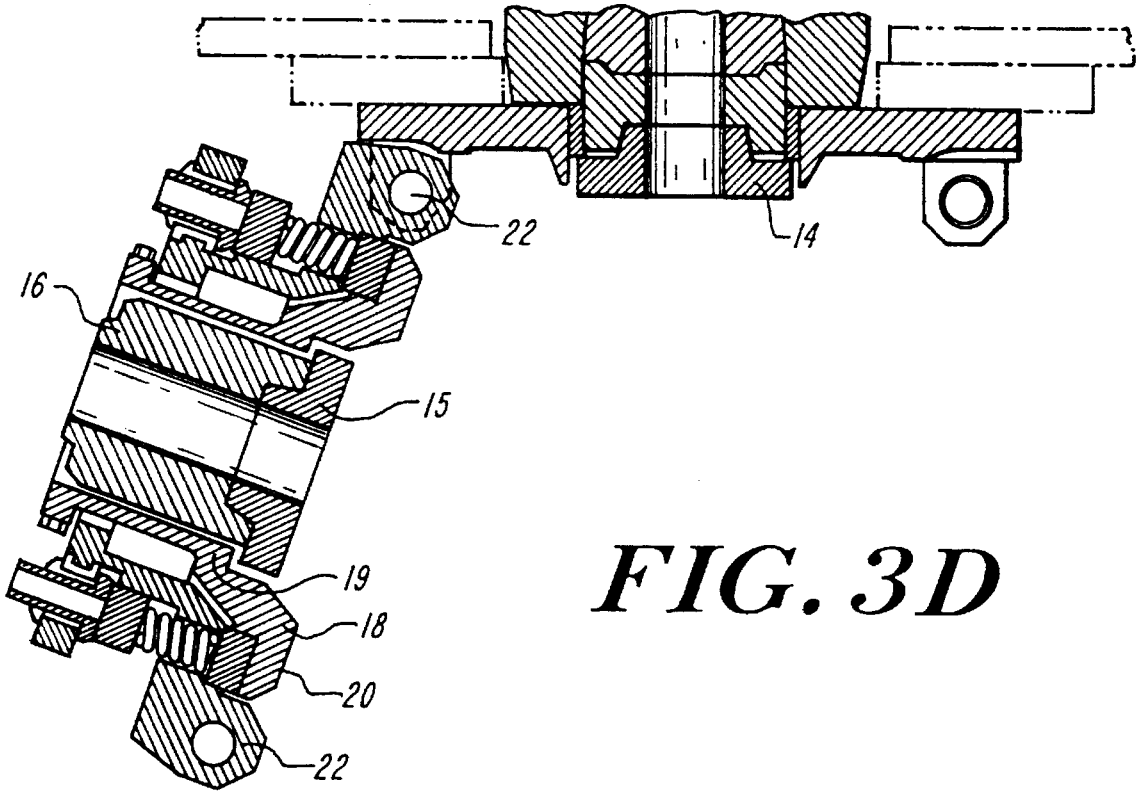

The sliding plate 15 is cradled by a plate carrier 18 in a cradle-like support or recess portion 19 thereof. A reciprocating ram 17 is coupled to the carrier 18 to slide the sliding plate 15, as shown in FIG. 2. The reciprocating ram 17 is mounted and arranged such that its line of action on the carrier 18 lies in the same plane as the interface between the plates 14 and 15. The direction of the force applied by the reciprocating ram is thus in the same plane.

The carrier 18 is movable within a support frame 22 which is pinned to sets of lugs 21 at either side of the valve assembly. One set of lugs 21 can provide for a hinge about which the support frame 22 can swing, together with the carrier 18 and the sliding plate 15, (as shown in FIG. 3(*d*)) to a dismantled position. The lugs 21 are integral with a mounting plate 11 fixed to the bottom of the vessel 12. The lugs and pins are centred on the interface plane.

The carrier 18 is biased upwardly by springs 25 as defined hereinbefore, (here shown as compression coil springs), to urge the sliding plate 15 sealingly against the fixed plate 14. The springs 25 act through blocks 26 against a rim portion 20 of the carrier 18. Each block 26 comprises a wear pad, e.g. of stainless steel. Each spring 25 extends through an opening in the support frame 22. The springs 25 in use are held between the blocks 26 and jacking or thrust means 29 mounted in a lower part 28 of the support frame 22. The thrust means 29 are movable from a non-compressing position shown in FIGS. 3(*c*) and 3(*d*) to a compressing position shown in FIGS. 1 and 3(*b*).

Each spring 25 is at its natural length when its associated thrust means 29 is in its non-compressing position. The spring 25 is compressed to its operating length when the thrust means 29 is moved to its compressing position. The thrust means 29 is here shown as comprising a bolt screw—threaded into a thrust bearing or sleeve.

The thrust means 29 and the springs 25 are removable from the support frame 22 as shown in FIG. 3(*a*). This permits removal and replacement of springs 25 without dismantling the valve assembly and without having to open the assembly as depicted in FIG. 3(*d*).

The carrier 18 is contained in the support frame 22 and is prevented from falling out of the frame 22 by a stop 23 formed on the carrier 18.

Each block 26 is a separate wear part and is mounted in an opening formed between the carrier 18 and the support frame 22. The spring 25 when compressed to its operating length acts on its associated block 26 through the opening formed in the support frame 22. The block 26 acts as part of a plate-biasing means with the associated spring 25. However, in the illustrated embodiment, the blocks 26 cannot fit through the openings formed in the support frame 22 and are thus not removable from the valve 10 in a similar way to the springs 25 (as shown in FIG. 3(*a*)).

FIG. 3(*b*) shows the springs 25 compressed to the operating length and the valve 10 is in its first position. The springs 25 urge the carrier 18 upwardly. The sliding plate 15 is thus biased into face to face contact with the fixed plate 14.

The contacting faces of the plates 14, 15 act as a seal against the ingress of molten metal. The contact faces of the plates 14, 15 meet along a contact plane.

The rim portion 20 of the carrier 18 extends upwardly from the support portion 19. The back face of the rim portion 20 against which the spring means acts is co-planar with the contact plane. This reduces or eliminates development of turning forces imparted to the carrier 18. Of course, slight mis-alignment of the back face will cause some turning forces, but will still show significant improvement over previously known arrangements.

In one specific embodiment, the valve 10 has a total of twelve springs 25 biasing the carrier 18. The springs 25 are mounted in two rows of six springs 25, one row along each side of the sliding plate 15. Each thrust means 29 may be designed to compress three of the springs 25 of one row. Accordingly, four thrust means 29 are used in the illustrated embodiments.

A three plate sliding gate valve could also incorporate the features of the present invention. In such a valve having a movable centre plate the back of the rim portion of the carrier would be coplanar with the movable plate and desirably would be disposed centrally of the thickness of said plate. Moreover, the line of action of the ram would be aligned with the back of the rim portion.

We claim:

1. A sliding gate valve for controlling the flow of molten metal from a vessel, the valve comprising an orificed fixed plate and an orificed sliding plate slidingly mounted on a support frame, the support frame being hingedly movable between an operating position where the sliding plate is in face to face contact with the fixed plate along a contact plane and another position moved therefrom, the sliding plate being biased into said face to face contact by biasing means which exert biasing force directly on to the contact plane.

2. The sliding gate valve according to claim 1, wherein the frame is pivotable about an axis parallel to the sliding direction of the sliding plate.

3. The sliding gate valve according to claim 1, which has a carrier mounting the sliding plate, and the carrier has a support portion abutting the non-contact face of the sliding plate and a rim portion extending from the support portion past the contact side of the sliding plate.

4. The sliding gate valve according to claim 3, wherein the biasing means acts against a back face of the rim portion which back face is co-planar with the contact plane.

5. The sliding gate valve according to claim 1, wherein the biasing means includes a spring.

6. The sliding gate valve according to claim 5, wherein the biasing means has a plurality, e.g. twelve, springs mounted about the sliding plate.

7. The sliding gate valve according to claim 5, wherein the biasing means further includes a wear block associated with the or each spring, the wear block being mounted between the associated spring and the contact plane and comprises e.g. a stainless steel pad.

8. The sliding gate valve according to claim 5, including adjustable spring compression means whereby the or each spring can be set in a first condition where the spring is at its free length and in a second condition where the spring is at a compressed length.

9. The sliding gate valve according to claim 8, wherein the spring compression means comprises a thrust bearing assembly adapted to compress the spring, the thrust bearing assembly and the spring being removable from the valve when the support frame is in its operating position.

10. The sliding gate valve according to claim 9, wherein the spring is removable whilst the sliding plate is in face to face contact with the fixed plate.

11. The sliding gate valve according to claim 1, wherein the sliding plate is slidable by means of a reciprocating ram, the reciprocating ram being adapted to apply a plate-actuating force along a line in the contact plane.

12. A vessel selected from a tundish, ladle and furnace such as a BOF furnace comprising the sliding gate valve according to claim 1.

* * * * *